US010334901B1

(12) United States Patent
Brooks

(10) Patent No.: US 10,334,901 B1
(45) Date of Patent: Jul. 2, 2019

(54) EMERGENCY HAIR WEAVE KIT

(71) Applicant: Anita Lucille Brooks, Oakland, CA (US)

(72) Inventor: Anita Lucille Brooks, Oakland, CA (US)

(73) Assignee: Anita Lucille Brooks, Oakland, CA (US)

( * ) Notice: Subject to any disclaimer, the term of this patent is extended or adjusted under 35 U.S.C. 154(b) by 171 days.

(21) Appl. No.: 15/478,243

(22) Filed: Apr. 3, 2017

(51) Int. Cl.
*A41G 5/00* (2006.01)
*A41G 3/00* (2006.01)

(52) U.S. Cl.
CPC ..... *A41G 5/0073* (2013.01); *A41G 3/0041* (2013.01); *A41G 5/008* (2013.01)

(58) Field of Classification Search
CPC .... A41G 5/0073; A41G 5/008; A41G 3/0066; A41G 3/0041
See application file for complete search history.

(56) References Cited

U.S. PATENT DOCUMENTS

2002/0166565 A1* 11/2002 Whitfield ..... A41G 3/0016 132/54
2010/0170523 A1* 7/2010 DePalma ..... A41G 3/00 132/54
2015/0034112 A1* 2/2015 Queen ..... A41G 3/0066 132/54
2016/0135531 A1* 5/2016 Ezechukwu ..... A41G 5/0073 132/201
2017/0215506 A1* 8/2017 Sim ..... A41G 5/0073

OTHER PUBLICATIONS

Youtube video titled "Quick Weave Tutorial" by FasherThanYou published on Mar. 3, 2015 and available at https://www.youtube.com/watch?v=-1_d7Kq4wb4.*

* cited by examiner

*Primary Examiner* — Blake A Tankersley

(57) ABSTRACT

Traditionally, hair weaves are attached semi-permanently to the user's hair or scalp with glue or sewing causing, at times, irreparable damage to the skin and hair. With the Emergency Hair Weave Kit, one can instantly adopt a completely new and trending hairstyle without the need to significantly damage, alter, or growing one's natural hair. The Emergency Hair Weave Kit is an apparatus that allows hair weaves to be attached and detached without the need for conventional sewing or hair glue. Tracks on the hair are prepared by fastener or snap components which will allow the user to quickly and easily attached the hair. As a result, the user can easily remove and quickly switch out hair weaves, allowing superior style options, flexibility and convenience.

4 Claims, 4 Drawing Sheets

EMERGENCY HAIR WEAVE KIT

FIELD OF THE INVENTION

The present invention generally relates to a hair product. More specifically, the present invention is a hair weaving kit apparatus.

BACKGROUND OF THE INVENTION

Hair weaving is a process that can add length and/or fullness to human hair. Hair weaving can be achieved through a number of methods. Some methods include glue-like components to attach to the user's hair.

The present invention is a glue free product hair weaving kit. Through the present invention, the user does not have to sew or glue it in. The tracks on the hair are already prepared with sticky fasteners or snap components. The components allow the user to stick it or snap it. Through the present invention, the user can remove the hair quickly and easily for other styles. The present invention provides no stress, no mess, no glue and no goo and lets the user create a finished look. The present invention allows for a quick and easy process that can be used in and emergency or non-emergency.

DETAIL DESCRIPTIONS OF THE INVENTION

All descriptions are for the purpose of showing selected versions of the present invention and are not intended to limit the scope of the present invention.

The present invention is a hair weaving kit apparatus. In its preferred embodiment, the present invention may be referred to herein after as the "Emergency Hair Weave Kit."

The present invention is an emergency hair kit, which comes complete with the following components:

1) Hair cap/w fasteners attached,
2) fourteen pieces of precut hair,
3) two strips of extra fasteners.

Figure 1:
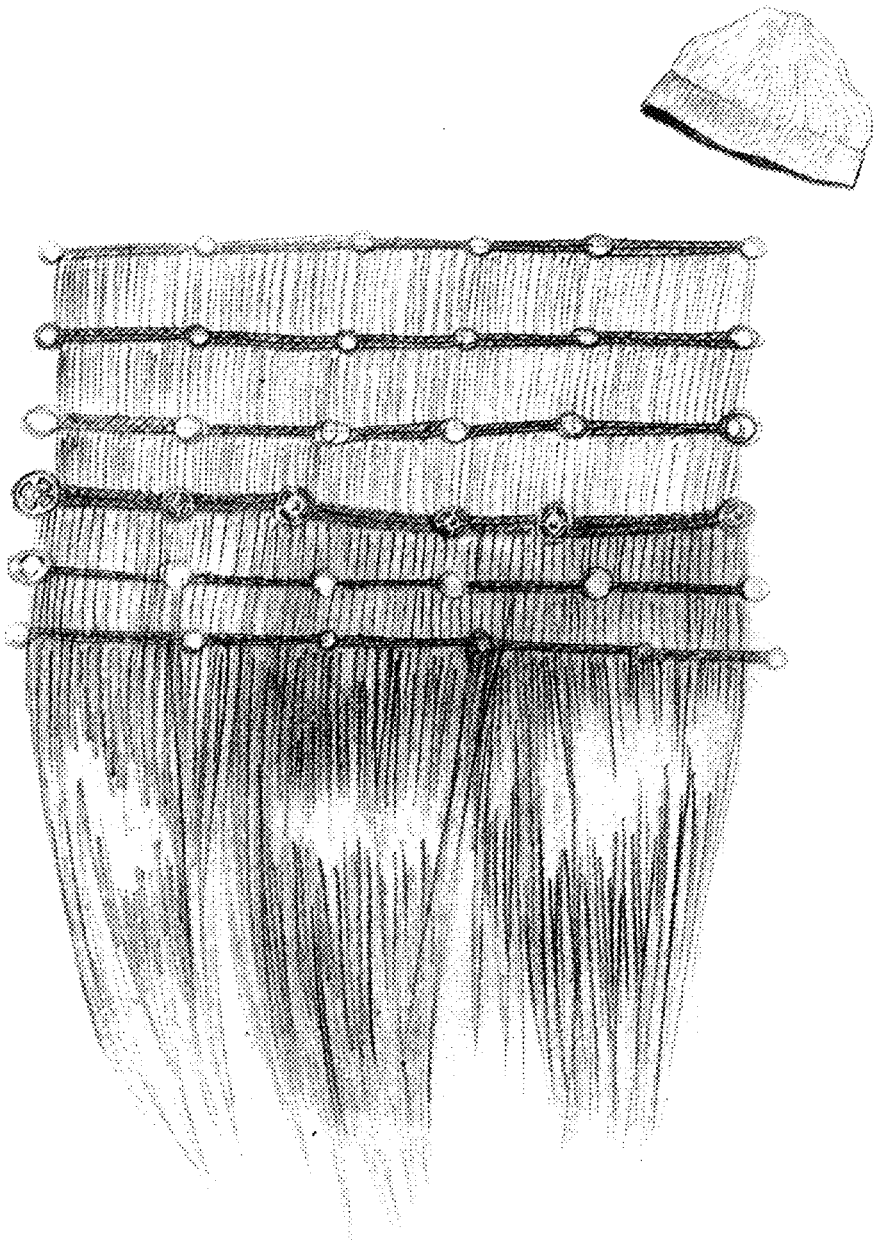
FIG. 1 is a perspective view of the present invention and its components in use in a preferred embodiment.
Figure 2:
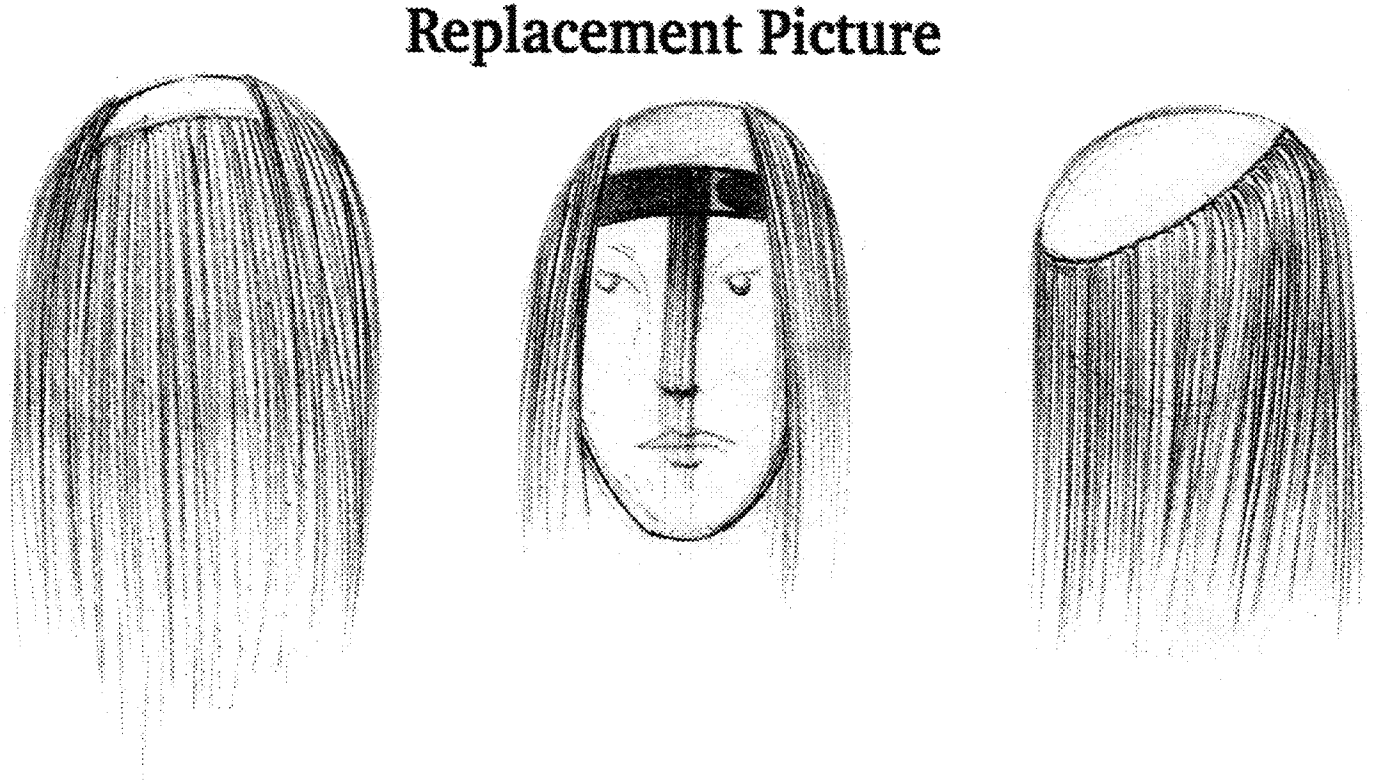
FIG. 2 is a multiple perspective view of the present invention and its components during different stages of the process.
Figure 3:
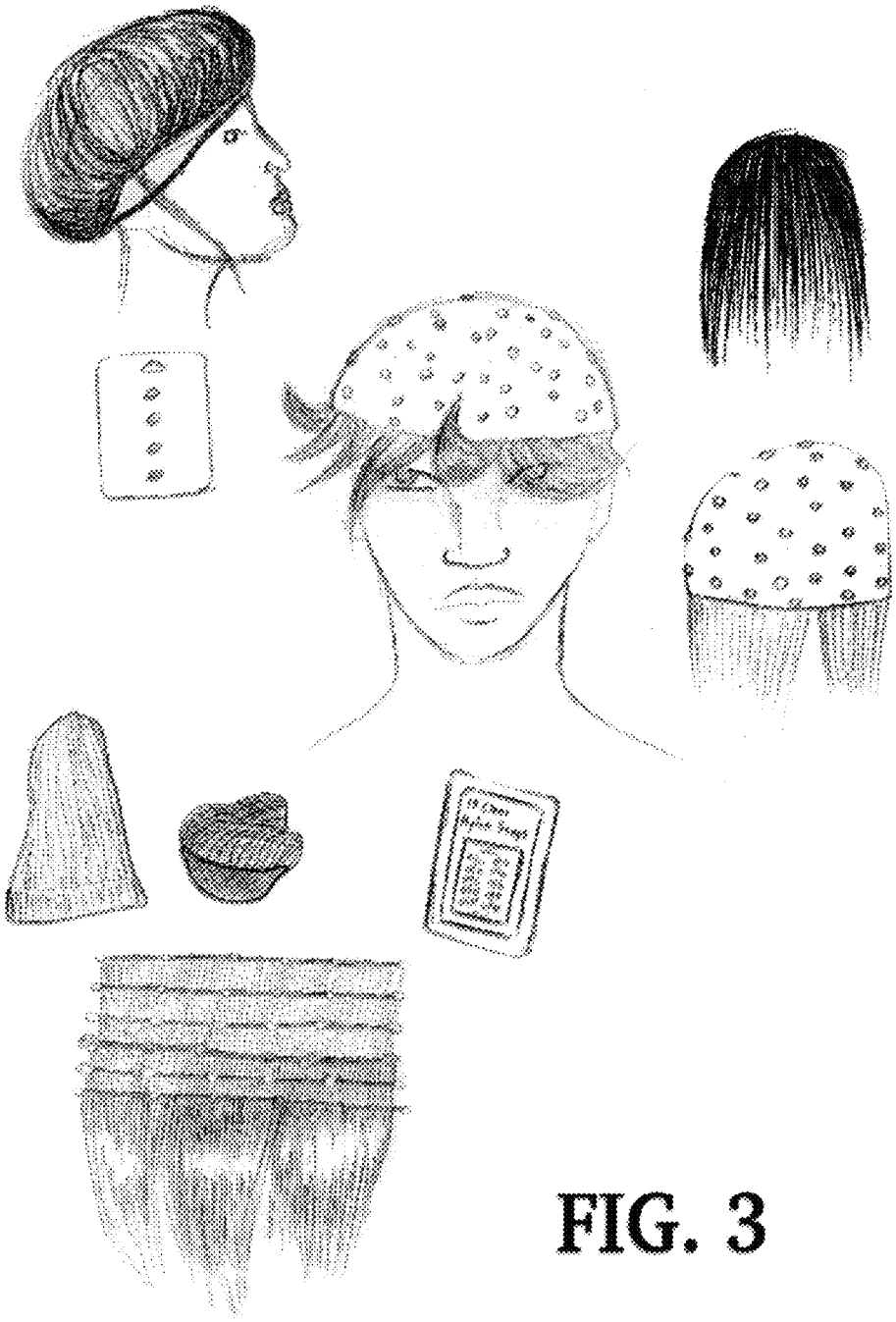
FIG. 3 is a perspective view of the present invention and its components in use in a preferred embodiment.
Figure 4:
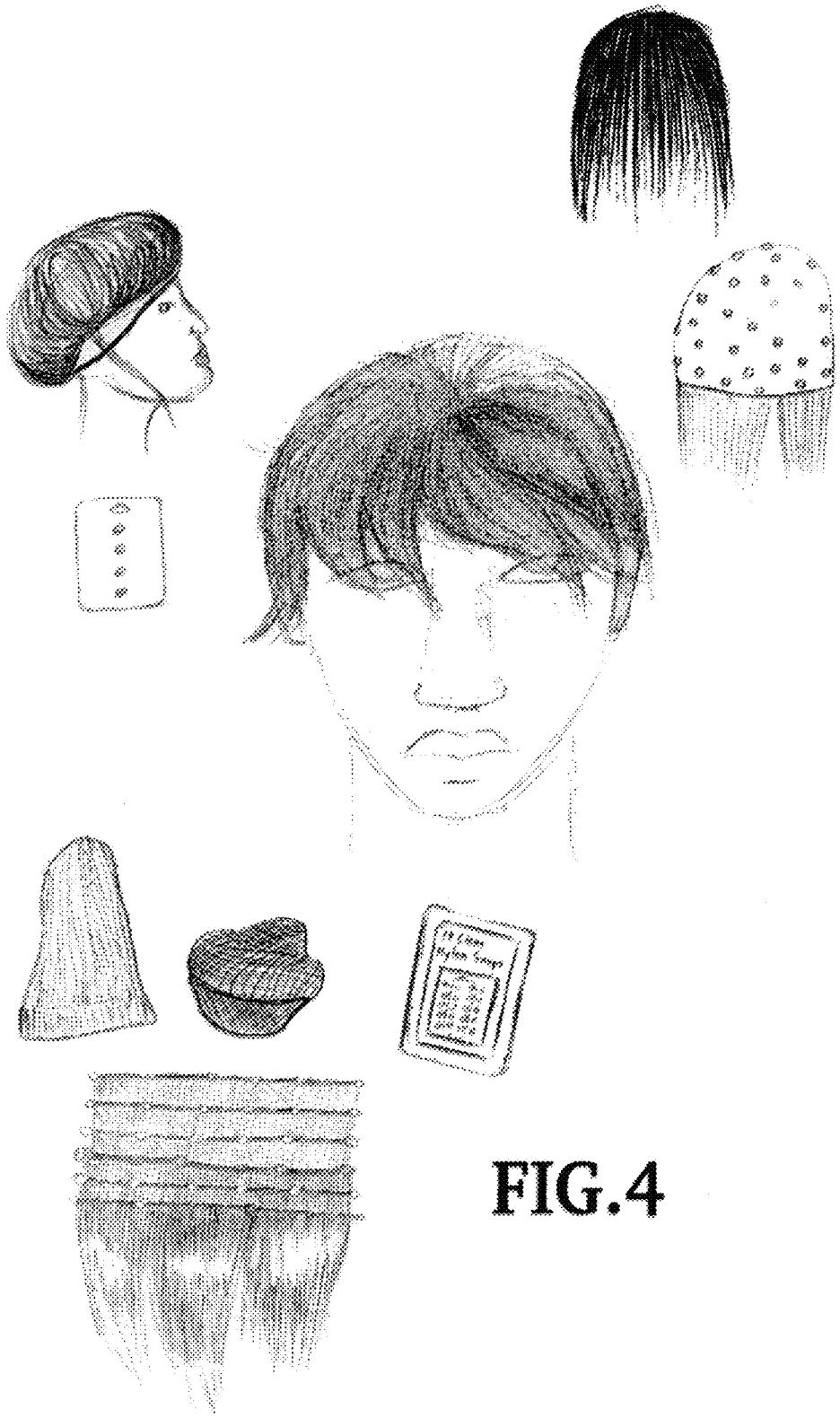
FIG. 4 is a perspective view of the present invention and its components in use in a preferred embodiment.

The emergency weave kit also contains one bottle of glue if the users wants to use the glue instead of the fasteners. However, glue is not necessary in achieving the present invention's function. The kits can be purchased with curly, straight, or kinky hair. Through the present invention, hair can be attached in no more than ten minutes. FIG. 2 shows different stages of the process.

Through its preferred embodiment, the Emergency Hair Weave Kit includes the following, including a sticky fastener Velcro ¾ inch strips) or Snaps:

(1) Weave Cap
(14) 14 pre-cut hair tracks (width) (sticky fastener or Snap)
(2) 18 inch tracks
(5) 13 inch tracks
(2) 11 inch tracks (3) 6-inch bang tracks
(1) closure piece
(2) Extra 18-inch hair track
with sticky fasteners attached or snaps Through the present invention, the sticky fasteners or snaps are already attached to the hair track stick or snap in place onto the weave cap. The user is also left with the choice of straight, curly, wavy. In addition, the user has a choice of lengths 10, 20, 21 inches.

Instructions for the user to utilize the present invention in its preferred embodiment:

1. To begin place the cap that is included in the kit on the head, or mannequin head removes protective film from the track and start placing the track as desired once in place hold the hair in place for a few minutes and proceed by adding one track at a time
2. Use whatever length of hair according to preferred style
3. Start at the bottom work way up (space layers between 1-2 inches apart)
4. Leave a small opening at the top place the closure at the opening
5. Cut and style the hair as preferred, if the hair is too thick remove the bottom track.

Snap Cap

Snap base is sewn into the top of hair track. In its preferred embodiment, 6-10 snaps sewn 3-4 inches apart on the track depending on the width.

1. Always start from the bottom up, pushing the snap base into the weave cap, and snap close
2. As you begin to place your tracks on your cap snap the closer into place locking the snap
3. Working in a circular motion from side to side until completion.
4. Placing one hair track at a time. Remember to leave a small opening for the closure
5. Now Lift and turn the cap up and snap closures into place. Work way up until all tracks are in place and closure snap are locked into place
6. Style as preferred
7. If hair is too full just snap out one, or more tracks
8. Closure fasteners (top of the snap)

Although the invention has been explained in relation to its preferred embodiment, it is understood that many other possible modifications and variations can be made without departing from the spirit and scope of the invention as herein described.

I claim:

1. A hair weaving kit comprising:

a hair cap having a top side and a bottom side;

a plurality of pieces of precut lengths of hair with at least one first snap attached to an end of each of the plurality of pieces of precut lengths of hair; and a plurality of mating second snaps for mating with the first snaps;

wherein there are no snaps attached to the hair cap; and wherein the mating second snaps and the first snaps are configured to attach the plurality of pieces of precut lengths of hair to the hair cap by placing the plurality of pieces of precut lengths of hair on the top side of the hair cap, placing the mating second snaps on the bottom side of the hair cap, and locking the mating second snaps to the first snaps with the hair cap sandwiched in between such that the plurality of pieces of precut lengths of hair are attached to the hair cap.

2. The hair weaving kit according to claim 1, further comprising a bottle of glue.

3. The hair weaving kit according to claim 1, wherein the plurality of pieces of precut lengths of hair are at least one of curly, straight, or kinky hair.

4. The hair weaving kit according to claim 1, wherein the at least one first snap attached to the end of each of the plurality of pieces of precut lengths of hair is a plurality of first snaps attached to the end of each of the plurality of pieces of precut lengths of hair.

* * * * *